US006460864B1

(12) United States Patent
Shieh

(10) Patent No.: US 6,460,864 B1
(45) Date of Patent: Oct. 8, 2002

(54) SHOE WITH DETACHABLE SPORTING DEVICE

(76) Inventor: Gary Shieh, 7F. No. 56, Lane 36, Shenhsi Road, Hsinyi District, Keelung (TW)

( * ) Notice: Subject to any disclaimer, the term of this patent is extended or adjusted under 35 U.S.C. 154(b) by 0 days.

(21) Appl. No.: 09/859,402

(22) Filed: May 18, 2001

(51) Int. Cl.[7] ..... A63C 17/00
(52) U.S. Cl. ..... 280/11.19; 280/7.13
(58) Field of Search ..... 280/7.13, 7.14, 280/11.14, 11.17, 11.225, 11.31, 11.3, 617, 618, 620, 625; 36/117.1

(56) References Cited

U.S. PATENT DOCUMENTS

| | | | | | |
|---|---|---|---|---|---|
| 2,950,118 | A | * | 8/1960 | Sharpe | 280/11.14 |
| 2,998,260 | A | * | 8/1961 | Meyer | 280/11.3 |
| 3,915,466 | A | * | 10/1975 | Matsuda | 280/607 |
| 3,963,251 | A | * | 6/1976 | Miano | 280/11.3 |
| 4,290,213 | A | * | 9/1981 | Salomon | 280/613 |
| 4,932,675 | A | * | 6/1990 | Olson et al. | 280/11.208 |
| 5,123,664 | A | * | 6/1992 | DeMars | 280/11.18 |
| 5,193,827 | A | * | 3/1993 | Olson | 280/11.231 |
| 6,015,156 | A | * | 1/2000 | Pratt | 280/11.224 |
| 6,145,854 | A | * | 11/2000 | Cheng | 280/11.224 |
| 6,217,035 | B1 | * | 4/2001 | Steinhauser, Jr. | 280/11.27 |
| 6,270,089 | B1 | * | 8/2001 | Marechal | 280/11.221 |
| 6,334,621 | B1 | * | 1/2002 | Chang | 280/11.221 |

FOREIGN PATENT DOCUMENTS

| | | | | |
|---|---|---|---|---|
| FR | WO9111232 | * | 8/1991 | A63C/9/00 |

* cited by examiner

*Primary Examiner*—Brian L. Johnson
*Assistant Examiner*—Kelly E. Campbell
(74) *Attorney, Agent, or Firm*—Bacon & Thomas, PLLC

(57) ABSTRACT

A shoe device. The device includes a shoe body such as a sports shoe and a coupling plate removably mounted on the shoe body. The coupling plate has a lower side mounted with a sporting device suitably used for various sports, such as a skate, an in-line skate, a roller skate or the like. The shoe body has a coupling hole and an engaging groove formed on a base portion of the shoe body, whereas the coupling plate has an upper side formed with a coupling protrusion and an engaging groove. The shoe body and the coupling plate are strongly coupled by engaging the coupling protrusion of the coupling plate with the coupling hole of the shoe body, and by inserting a fixing member between the engaging groove of the shoe body and the engaging groove of the coupling plate.

5 Claims, 7 Drawing Sheets

SHOE WITH DETACHABLE SPORTING DEVICE

FIELD OF THE INVENTION

The present invention relates to shoe devices, and more particularly, to a shoe device, which provides various uses, and has economical and convenient properties.

BACKGROUND OF THE INVENTION

Shoes are one of the necessities for doing sports. Wearing a pair of shoes specially designed for a particular sport helps a person do the sport more smoothly, for example, roller skates or skates are required for skating. As such, however, problems are generated, for example, it is quite troubling to purchase, store and carry quite a few pairs of shoes required for doing various sports. In addition, people normally can not afford to buy all of the shoes for different uses.

SUMMARY OF THE INVENTION

It is therefore an objective of the present invention to provide a shoe device with a coupling plate and a fixing member being removably mounted thereon, such that different uses of the shoe device can be alternated only by removing or mounting the binding plate and the fixing member, so as to provide economical purchase and convenience for usage, carriage and storage thereof.

In order to achieve the foregoing and other objectives, the invention proposes a shoe device comprising:

a shoe body having at least a coupling hole formed on a base portion of the shoe body, and an engaging groove formed in a middle portion thereof, which has an opening connecting a side surface of the shoe body and extends along a crosswise direction of the shoe body;

a coupling plate having an upper side attached to the base portion of the shoe body and formed with at least a coupling protrusion being removably coupled to the corresponding coupling hole in the base portion of the shoe body, a middle portion formed with an engaging groove being removably engaged with the engaging groove in the base portion of the shoe body, and a lower side mounted with a sporting device suitably used for various sports; and a fixing member with a length no longer than the width of the base portion of the shoe body, having an upper side formed with an engaging strip being removably engaged with the engaging groove in the base portion of the shoe body, and a lower side formed with an engaging strip being removably engaged with the engaging groove of the coupling plate.

BRIEF DESCRIPTION OF THE DRAWINGS

The invention can be more fully understood by reading the following detailed description of the preferred embodiments, with reference made to the accompanying drawings, however, the invention is not limited to said embodiments and drawings.

DETAILED DESCRIPTION OF THE PREFERRED EMBODIMENTS

Figure 1:
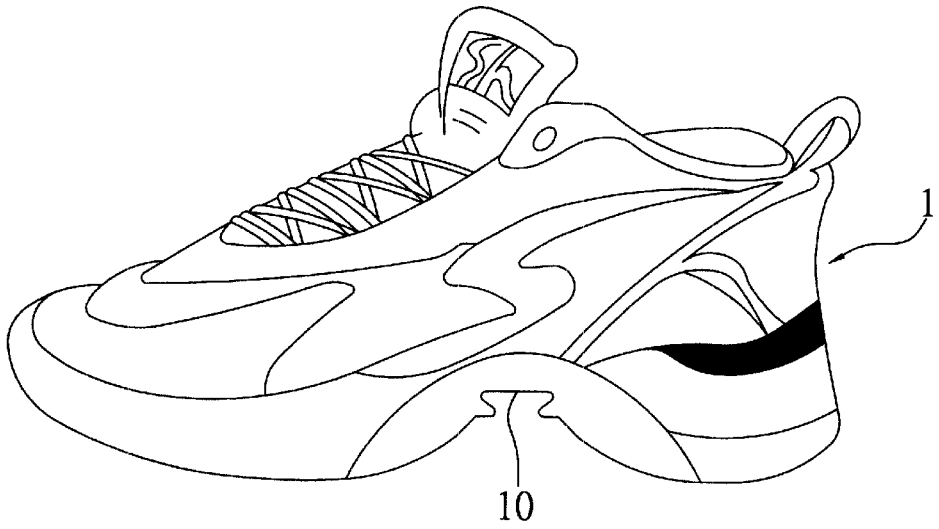
FIG. 1 is a front view of the shoe device of the invention.
Figure 2:
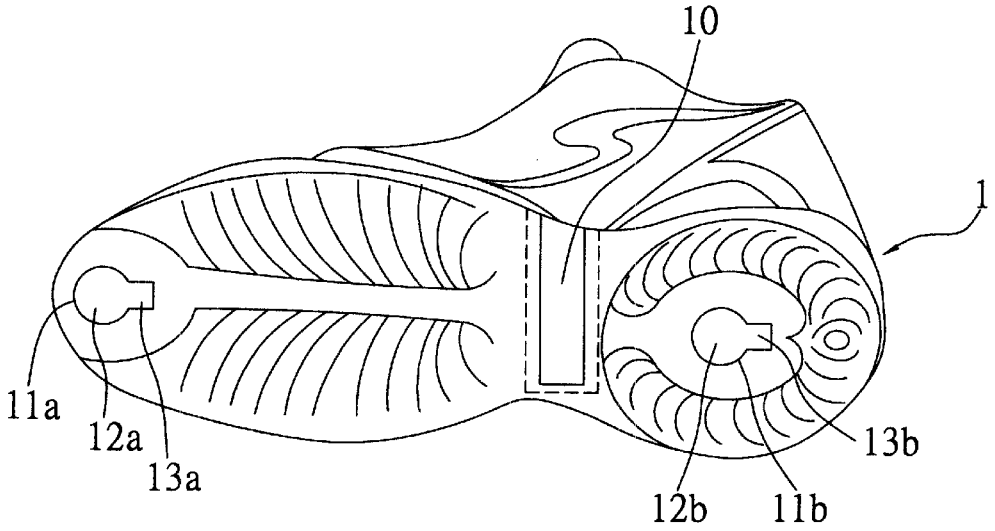
FIG. 2 is an oblique view of the shoe device of the invention.
Figure 3:
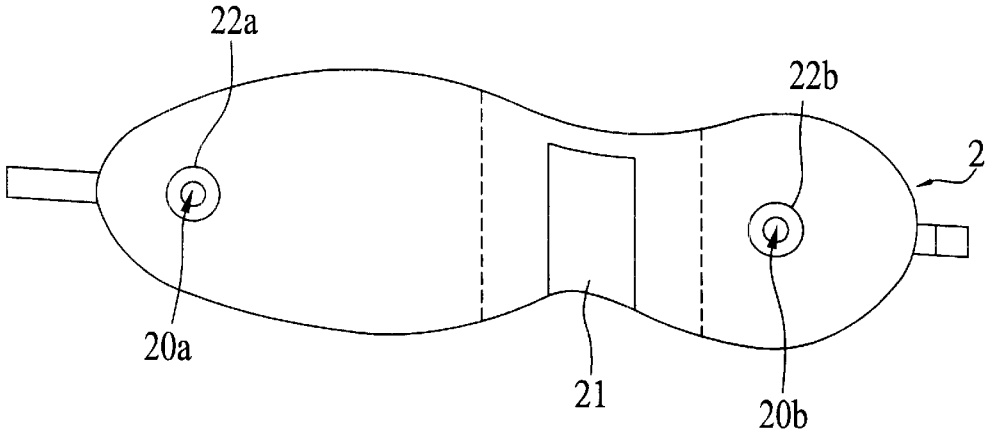
FIG. 3 is a bottom view of a coupling plate used in the shoe device of the invention.
Figure 4:
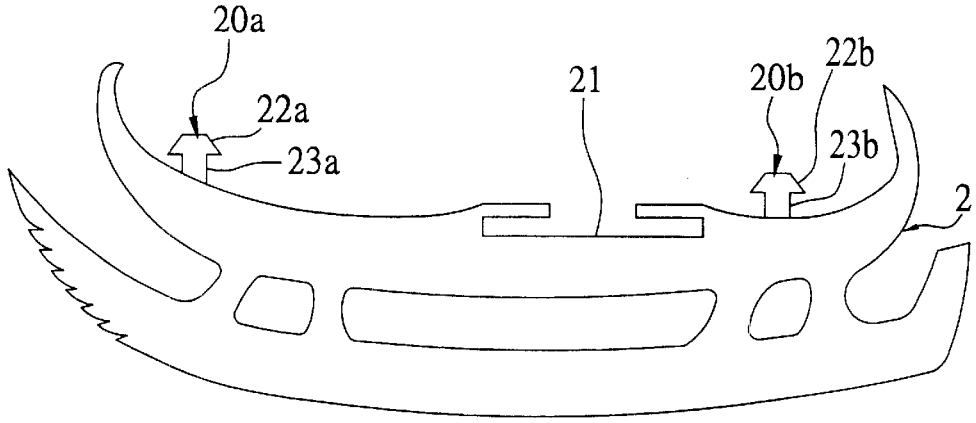
FIG. 4 is a front view of a coupling plate used in the shoe device of the invention.

Referring to FIG. 1 and FIG. 2, a shoe body 1 has one or more than one coupling holes 11*a*, 11*b* (two are shown in the drawing) formed on a base portion of the shoe body 1. The coupling holes 11*a*, 11*b* consist of inserting holes 12*a*, 12*b* and coupling grooves 13*a*, 13*b*, which are connected to and shorter in width than the inserting holes 12*a*, 12*b*; the inserting holes 12*a*, 12*b* and the coupling grooves 13*a*, 13*b* have openings at the bottom of the shoe body smaller than those at the interior of the shoe body. Moreover, the shoe body 1 has a middle portion formed with a wedge-shaped engaging groove 10 having an opening connecting a side surface of the shoe body and extending along a crosswise direction of the shoe body. Referring to FIG. 3 and FIG. 4, a coupling plate 2 has an upper side attached to the base portion of the shoe body 1 and formed with one or more than one coupling protrusions 20*a*, 20*b* (two are shown in the drawing) thereon. The coupling protrusions 20*a*, 20*b* consist of short pillars 23*a*, 23*b* fixed on the coupling plate 2 and heads 22*a*, 22*b* larger in size than the short pillars 23*a*, 23*b* and fixed on ends of the short pillars 23*a*, 23*b*; the heads 22*a*, 22*b* are smaller in size than the openings of the inserting hole 12*a*, 12*b* at the bottom of the shoe body, but larger than the openings of the coupling grooves 13*a*, 13*b* at the bottom of the shoe body. Moreover, the coupling plate 2 has a middle portion formed with an engaging groove 21 used to removably engage with an engaging strip 31 of a fixing member 3 described later. In addition, the coupling plate 2 has a lower side mounted with a sporting device suitably used for various sports (a skate is shown in the drawing).

Figure 5:
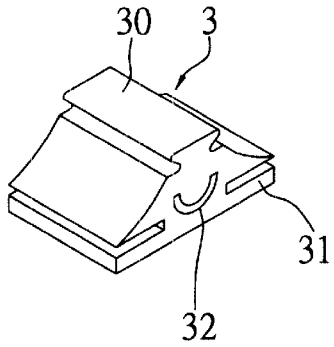
FIG. 5 is a perspective view of a fixing member used in the shoe device of the invention.

Referring to FIG. 5, the fixing member 3 with a length no longer than the width of the shoe body 1 has an upper side formed with an engaging strip 30 being removably engaged with the engaging groove 10 in the base portion of the shoe body 1, and a lower side formed with the engaging strip 31 being removably engaged with the engaging groove 21 of the coupling plate 2. Additionally, the fixing member 3 is formed with a hollow deformable auxiliary groove 32 approximately in the central portion along a lengthwise direction of the fixing member 3.

Figure 6:
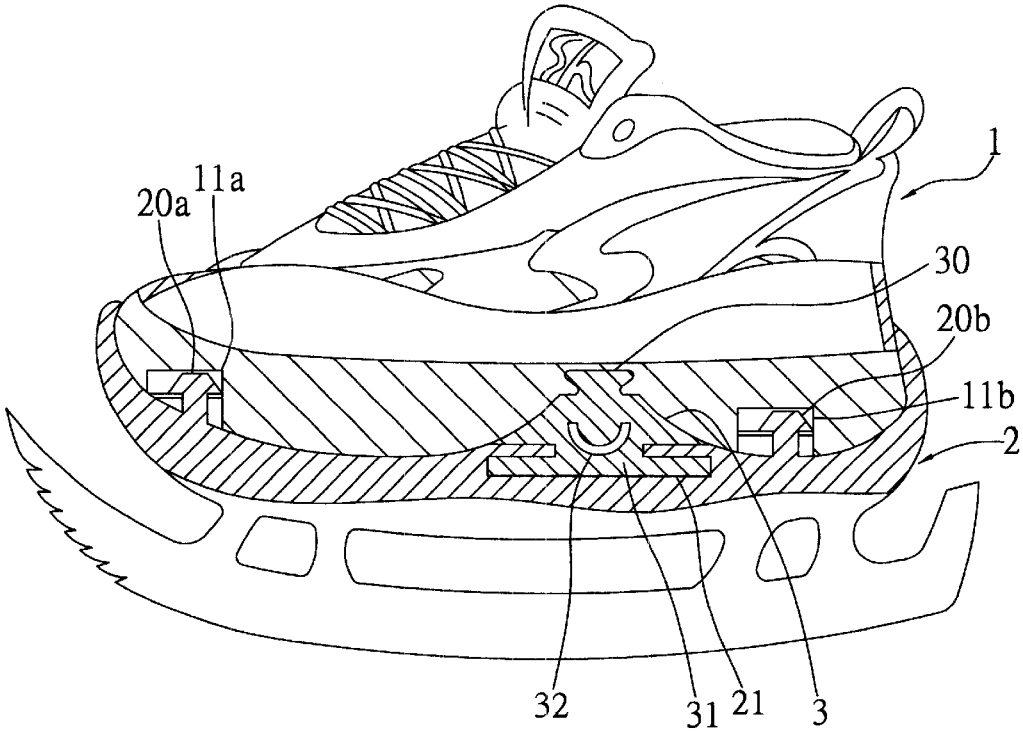
FIG. 6 is a schematic diagram showing an assembled form of the shoe device of the invention.

Referring to FIG. 6, illustrating an assembled form of the shoe device of the invention (a skate is shown in the drawing), coupling and engagement are assured between the engaging groove 10 in the base portion of the shoe body 1 and the engaging strip 30 of the fixing member 3 and between the engaging groove 21 of the coupling plate 2 and the engaging strip 31 of the fixing member 3, due to the wedge-shaped structures of the grooves 10, 21 and the strips 30, 31, so as to prevent the decoupling of those structures from occurrence when using the shoes.

As such, when exercising or walking, due to the coordinating arrangement of the coupling plate 2 and the shoe body 1, the counter force generated against the force produced by the body weight applied to the ground can be eliminated by the deformable auxiliary groove 32 of the fixing member 3, so as to achieve a shock-resistant effect.

Figure 7:
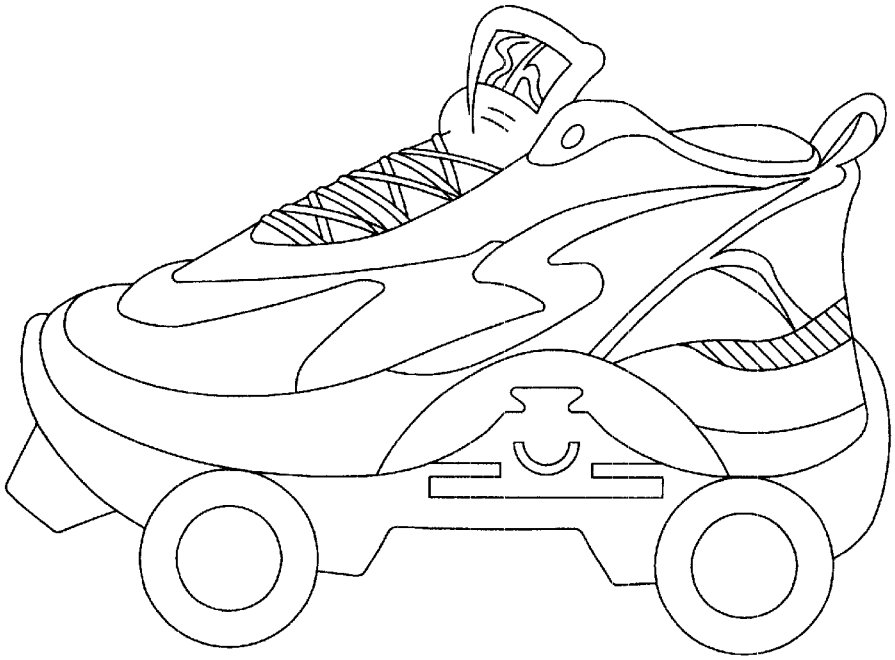
FIG. 7 is a schematic diagram showing one embodiment of the shoe device of the invention.

FIG. 7 illustrates one embodiment of the shoe device of the invention, wherein the shoe is a roller skate for skating.

Figure 8:
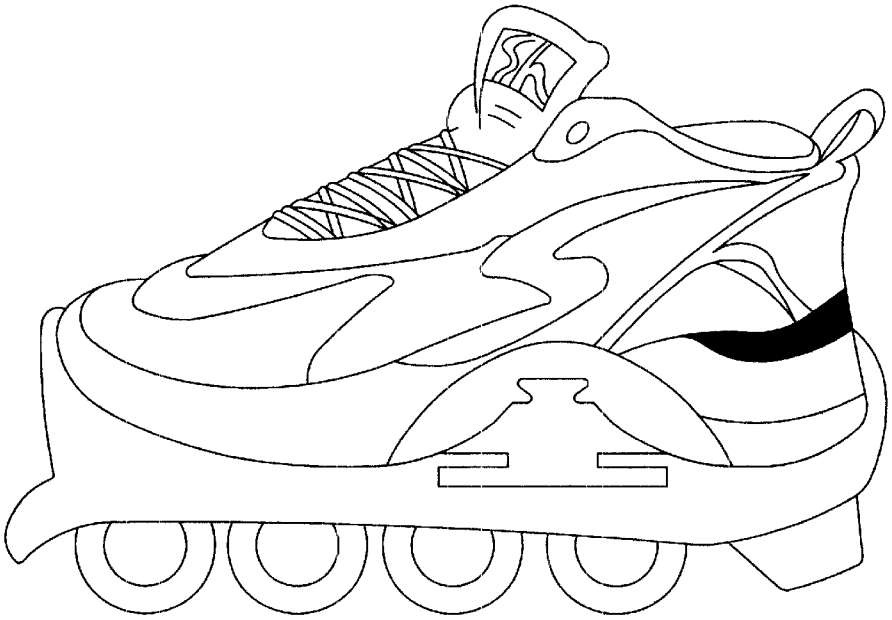
FIG. 8 is a schematic diagram showing another embodiment of the shoe device of the invention.

FIG. 8 illustrates another embodiment of the shoe device of the invention, wherein the shoes are in-line skates for skating.

Figure 9:
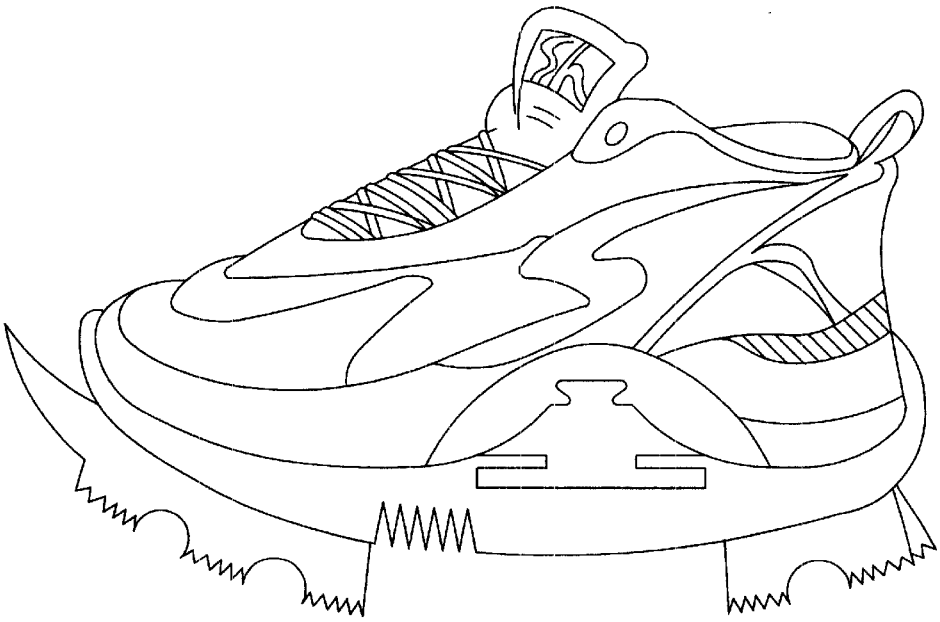
FIG. 9 is a schematic diagram showing still another embodiment of the shoe device of the invention.

FIG. 9 illustrates still another embodiment of the shoe device of the invention, wherein the shoe is a spike for track and field.

Figure 10:
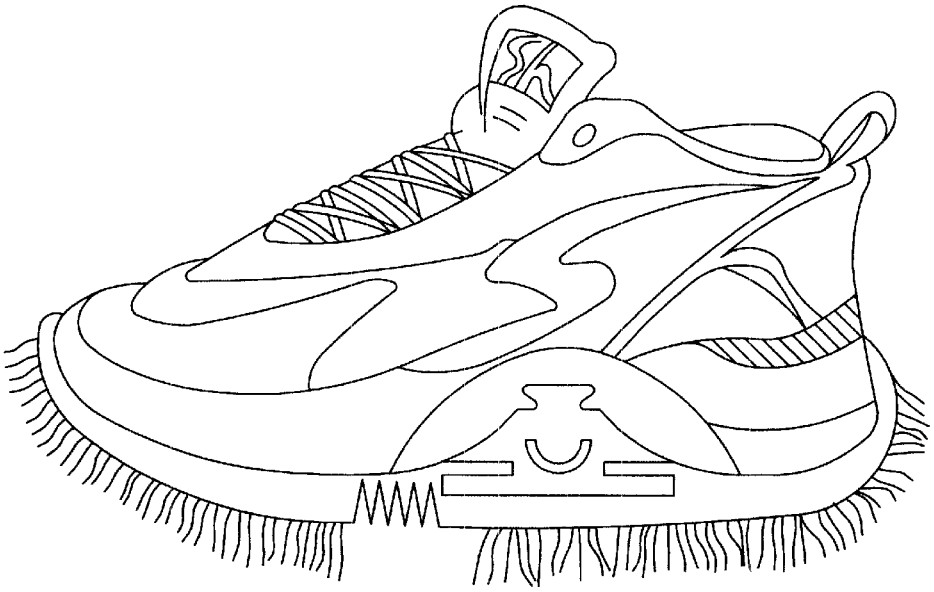
FIG. 10 is a schematic diagram showing a further embodiment of the shoe device of the invention.

FIG. 10 illustrates a further embodiment of the shoe device of the invention, wherein the shoe is an anti-slippery shoe used for resisting the slippage thereof.

Figure 11:
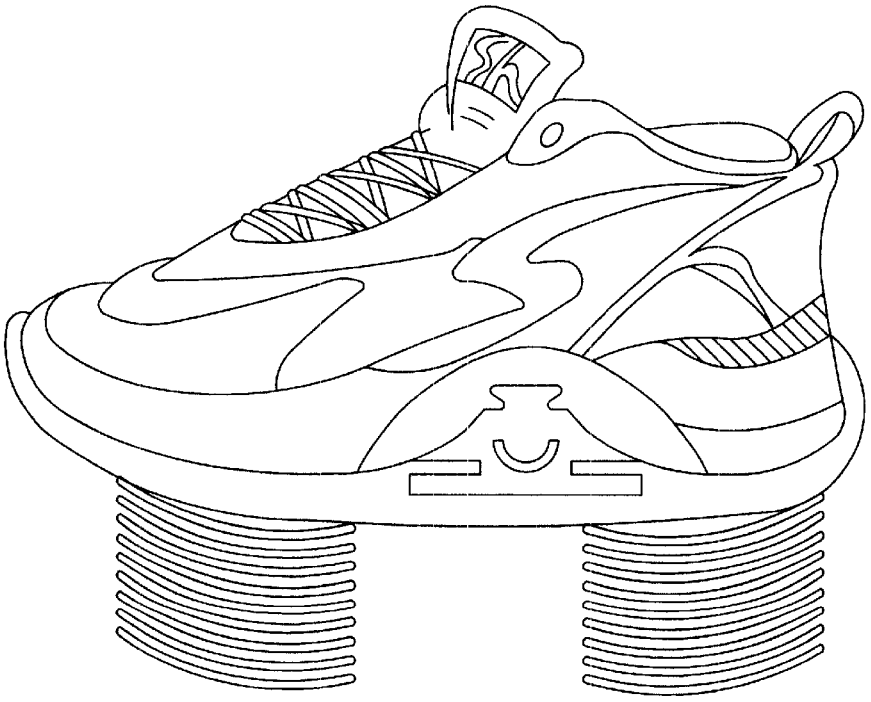
FIG. 11 is a schematic diagram showing a further embodiment of the shoe device of the invention.

FIG. 11 illustrates a further embodiment of the shoe device of the invention, wherein the shoe is a spring-heeled shoe used for decorating the appearance thereof.

Figure 12:
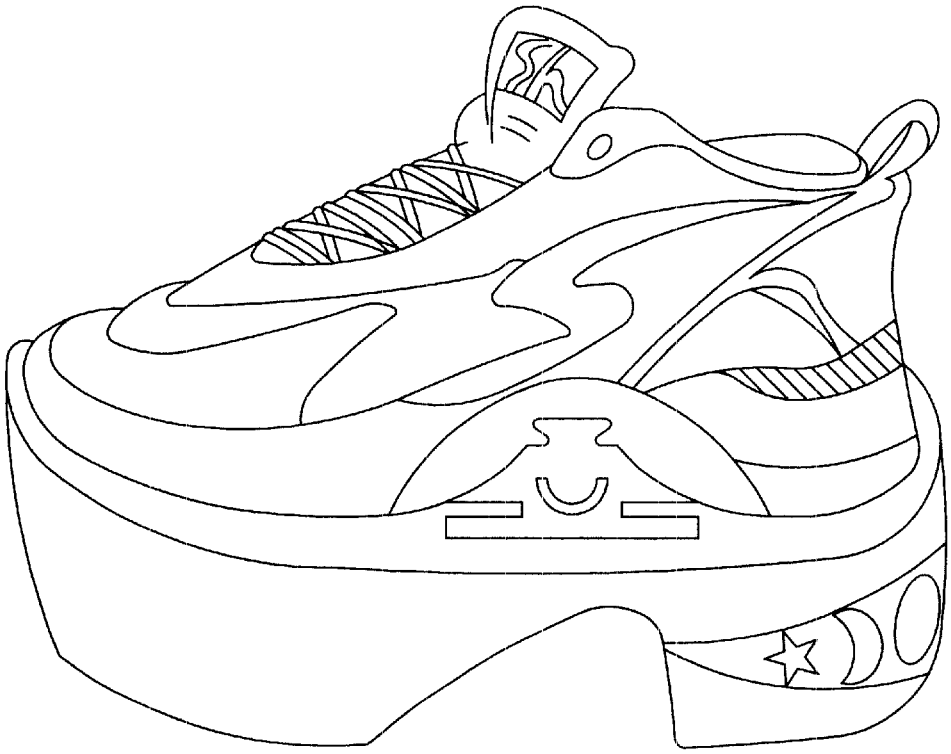
FIG. 12 is a schematic diagram showing a further embodiment of the shoe device of the invention.

FIG. 12 illustrates a further embodiment of the shoe device of the invention, wherein the shoe is a platform shoe used for increasing the height thereof.

Figure 13:
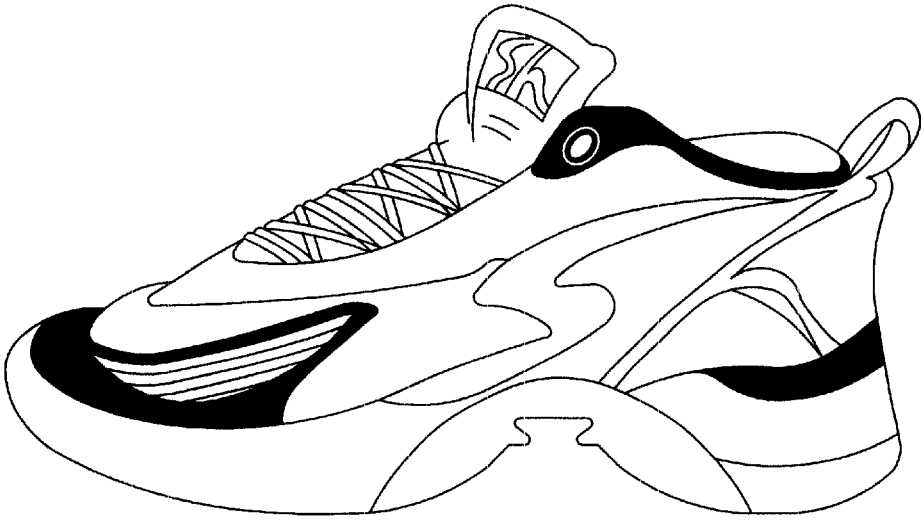
FIG. 13 is a schematic diagram showing a further embodiment of the shoe device of the invention.

FIG. 13 illustrates a further embodiment of the shoe device of the invention, wherein the shoe is directly used as a sports shoe without the coupling plate 2 and the fixing member 3 mounted thereof.

In conclusion, the shoe device of the invention provides various uses, which are alternated only by exchanging the coupling plates 2 for doing different sports, such that it is not necessary to buy quite a few pairs of shoes, and it can save the expense for purchasing the shoes and space for storing the shoes, and thus higher economical and convenient properties are provided. In addition, the shoe device of the invention can reduce the risk for the occurrence of injuries to ankles when wearing the shoes, due to the shock-resistant effect of the deformable auxiliary groove 32 of the fixing member 3. Meanwhile, the shoe device of the invention can satisfy people who prefer to have a higher height, due to an additional height provided by the coupling plate 2 mounted thereon.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modification and similar arrangements.

What is claimed is:

1. A shoe with a detachable sporting device comprising:

an operable shoe body having a coupling means formed on a base portion of the shoe body, wherein the coupling means is recess-shaped to be free of interference with operational interaction between the shoe body and the ground, and wherein the coupling means includes at least one coupling hole and a first engaging groove that traverses across a middle part of the base portion of the shoe body;

a fixing member formed with an upper engaging strip and a lower engaging strip opposed to the upper engaging strip allowing the upper engaging strip to be detachably engaged with the first engaging groove of the shoe body; and a detachable sporting device adapted to be detachably connected to the base portion of the shoe body and the fixing member, wherein the detachable sporting device is formed at an upper side thereof with at least one coupling protrusion and a second engaging groove respectively corresponding in position to the coupling hole of the shoe body and the lower engaging strip of the fixing member, whereby the coupling protrusion is engaged with the coupling hole of the shoe body, and the second engaging groove is engaged with the lower engaging strip of the fixing member; wherein the fixing member is formed with a deformable auxiliary groove approximately in a central portion along a lengthwise direction of the fixing member, for enhancing deformation of the fixing member.

2. The shoe device of claim 1, wherein the coupling hole of the shoe body comprises an inserting hole and a coupling groove connected to and smaller in width than the inserting hole, and the inserting hole and coupling groove have openings at the bottom of the shoe body smaller than those at the interior of the shoe body; the coupling protrusion, formed on the coupling plate and coupled to the coupling hole, comprises a short pillar fixed on the coupling plate and a head being larger in size than the short pillar and fixed on one end of the short pillar; and the head is smaller in size than the opening of the inserting hole at the bottom of the shoe body, but larger than the opening of the coupling groove at the bottom of the shoe body.

3. The shoe device of claim 1 or 2, wherein a set of the coupling holes in the base portion of the shoe body and the coupling protrusion of the coupling plate are provided in the front portion and the rear portion of the shoe respectively.

4. The shoe device of claim 1, wherein the first engaging device in the base portion of the shoe body and the third engaging device of the fixing member, and the second engaging device of the coupling plate and the fourth engaging device of the fixing member are all wedge-shaped structures.

5. The shoe device of claim 1, wherein the sporting device consists of the group selected from a roller skate, a skate, an in-line skate, a spike, an anti-slippery shoe, a spring-healed shoe and a platform shoe.

* * * * *